United States Patent [19]

Stephens et al.

[11] Patent Number: 4,821,471

[45] Date of Patent: Apr. 18, 1989

[54] BUILDING PANEL

[75] Inventors: Norman M. Stephens, Aldergrove; John B. McRae, Coquitlam, both of Canada

[73] Assignee: 501 Diamond Arch Systems Canada Inc., Port Coquitlam, Canada

[21] Appl. No.: 60,925

[22] Filed: Jun. 12, 1987

[51] Int. Cl.[4] ..... E04B 1/32

[52] U.S. Cl. ..... 52/81; 52/DIG. 10; 52/596

[58] Field of Search ..... 52/DIG. 10, 81, 596, 52/602, 250

[56] References Cited

U.S. PATENT DOCUMENTS

| | | | |
|---|---|---|---|
| 196,171 | 9/1963 | Patterson | 52/81 |
| 1,999,426 | 4/1935 | Thayer | 52/250 |
| 2,891,491 | 6/1959 | Richter | 52/81 |
| 3,026,651 | 3/1962 | Richter | 52/81 |
| 3,090,165 | 5/1963 | Chiado | 52/602 |
| 3,500,601 | 3/1970 | Hamill | 52/602 |
| 3,568,381 | 3/1971 | Hale | 52/DIG. 10 |
| 3,729,876 | 5/1973 | Kolozsvary | 52/81 |
| 3,774,358 | 11/1973 | Hale | 52/81 |
| 3,874,141 | 4/1975 | Olson et al. | 52/81 |
| 3,881,284 | 5/1975 | Martin | 52/DIG. 10 |
| 3,974,600 | 8/1976 | Pearce | 52/DIG. 10 |
| 4,180,950 | 1/1980 | Foster | 52/81 |
| 4,330,969 | 5/1982 | Quaney | 52/602 |
| 4,531,333 | 7/1988 | Huegy | 52/DIG. 10 |

*Primary Examiner*—Carl D. Friedman
*Assistant Examiner*—Caroline D. Dennison
*Attorney, Agent, or Firm*—Bull, Housser & Tupper

[57] ABSTRACT

A generally quadrilateral-shaped building panel has a dihedral root portion extending along a major axis which bisects a pair of oppositely disposed corners. The panel has two similar triangular panel portions which extend from the root portion at a nominal dihedral angle to each other when viewed along the major axis. The panel has margin portions extending along each side edge thereof which can be secured to similar margin portions of adjacent panels. Each triangular panel portion has a crowned central portion which is displaced laterally from a nominal plane containing the margin portions of two side edges of the respective triangular panel and the dihedral root portion. The crowned central portion merges smoothly with adjacent margin portions and acts as an arch so that the panel is subjected mostly to compressive forces. This permits the use of fiber reinforced cement composite material as a substitute for common metal sheets, which can tolerate and are usual under tensile forces.

15 Claims, 5 Drawing Sheets

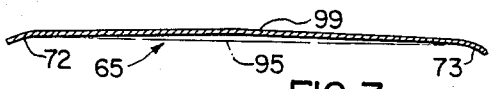
FIG. 7
FIG. 8
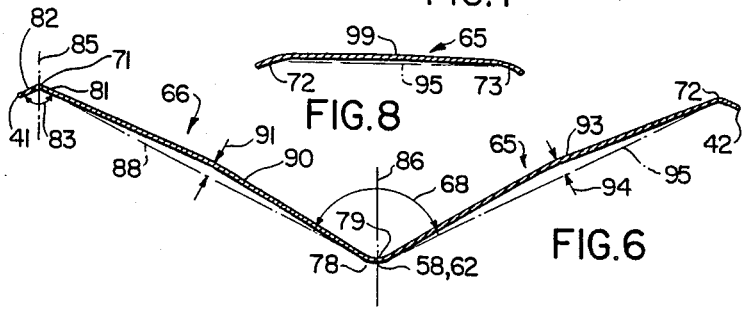
FIG. 6
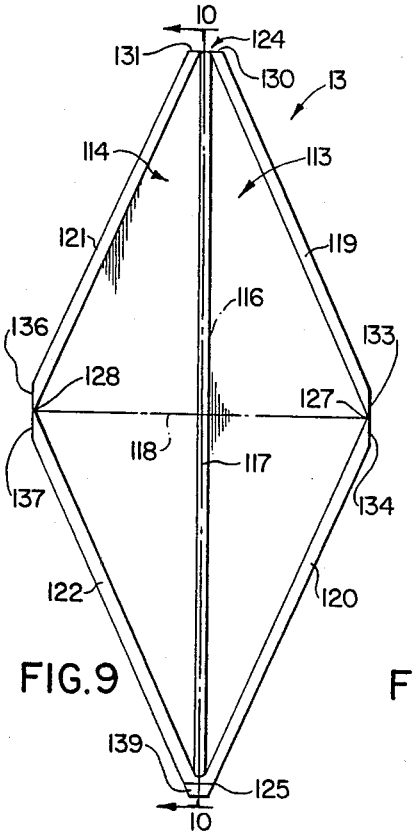
FIG. 9
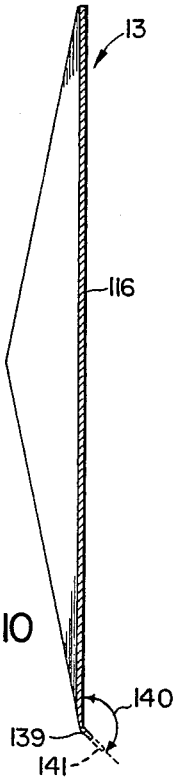
FIG. 10

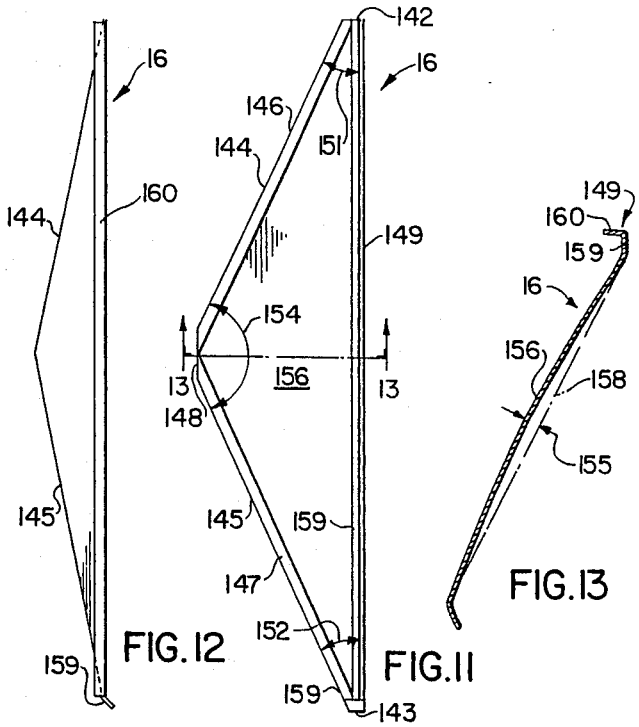
16
144
160
145
159
FIG. 12
142
16
146
151
144
149
154
156
13
13
148
145
159
147
152
159
143
FIG. 11
149
160
159
16
156
158
155
FIG. 13
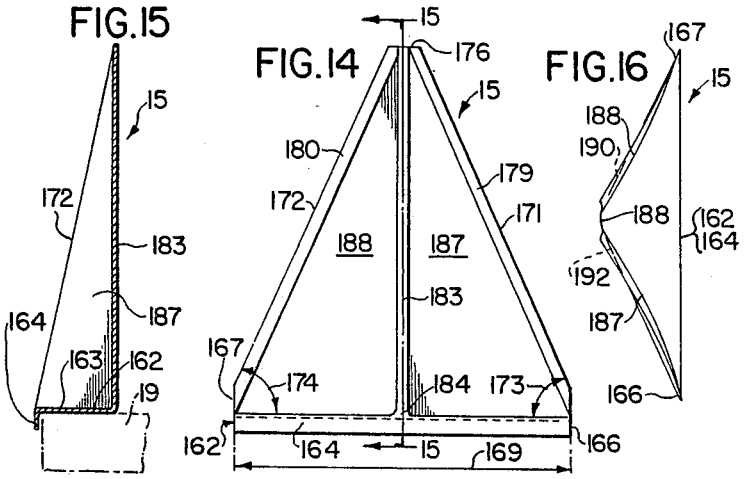
FIG. 15
15
172
183
187
164
163
162
19
FIG. 14
15
176
15
180
179
172
171
188
187
183
167
174
184
173
162
164
15
169
166
FIG. 16
167
15
188
190
188
162
164
192
187
166

BUILDING PANEL

BACKGROUND OF THE INVENTION

The invention relates to building panels which can be assembled, on site, to produce a self-supporting building assembly adaptable to many uses.

Pre-fabricated buildings, or "knock-down buildings" have been developed for many years and have many applications such as living quarters for people or animals, storage of equipment, temporary workshops, etc. A wide variety of building materials has been used, and the present invention is particularly adapted to the type of composite material commonly known as fibre reinforced cement. In the past, asbestos fibres were used, but nowadays safer alternative fibres are available, some being of wood products. This reinforced material is characterized by relatively low cost, high fire resistance, high thermal insulation, low maintenance requirements particularly with reference to rot and mildew problems, and the ability to be fabricated using "low technology" methods and equipment, which is particularly applicable for use in third world countries.

However, one problem associated with fibre reinforced cement building panels is that they tend to be relatively heavy in order to provide sufficient strength to overcome inherent weakness of the material when subjected to tensile stresses. Failure under low tensile stresses can occur when a poorly supported panel sags or bends under its own weight. Steel reinforcing may be needed in some prior art panels.

Prior art buildings assembled from fibre reinforced cement building panels usually require additional support members to provide adequate strength both to sustain the weight of the relatively heavy building panels, and to support the panels against deformation under their own weight. Such buildings commonly require specialized equipment for erection, and thus weight of the panels limits their use to areas having adequate transportation services for delivering the heavy panels to the building site.

Some prior art buildings are made from sheet metal, particularly rust resistant steel. A building panel particularly adapted for fabrication from sheet metal is disclosed in Canadian Pat. No. 1,004,822 and U.S. Pat. No. 3,874,141. The panels of the above patents derive their strength from the three-dimensional configuration of the plates, which are generally a ribbed and folded symmetrical quadrilateral with means for connecting to adjacent similar panels along edges of the panels. The panels of this patent can be fabricated relatively easily from sheet steel, and are lightweight and thus can be easily erected by relatively unskilled labour at the building site. However, the cost of sheet steel can be prohibitive in some third world countries, and thus buildings assembled from steel panels of this type are not economical for use in such situations.

SUMMARY OF THE INVENTION

The invention reduces the difficulties and the disadvantages of the prior art by providing modular building panels which resemble in some aspects the steel panels of the above patents, but are fabricated from a fibre reinforced cement composition instead of steel. The geometry of the panels has been has been re-designed considerably from the patented steel panels to accommodate the inherent weakness of the reinforced cement material when subjected to tensile forces. By re-designing the panels in this way, relatively thin composite panels can be made, which can be stronger than a common steel panel of this type and yet still be capable of being handled by men on a building site without specialized lifting equipment. Furthermore, the panel of the invention relies on its strength by its geometry, and can be easily joined to adjacent panels with common fasteners, without requiring additional supporting structure. Consequently, the panels can be easily transported to a building site without requiring specialized heavy hauling equipment, and can be assembled on site using unskilled labour without specialized forms or lifting equipment. Furthermore, as the panels are fabricated from the reinforced cement material composite, the panels have the inherent desirable characteristics of fire resistance, good thermal insulation, rot and mildew resistance which reduces considerably maintenance costs, and can be fabricated easily without "high technology" manufacturing methods or equipment.

A building panel according to the invention has a periphery including four generally straight side edges which define a generally quadrilateral panel. The panel has a pair of oppositely disposed first corners defined by intersecting side edges inclined to each other at equal first angles, and a pair of oppositely disposed second corners defined by intersecting side edges inclined to each other at equal second angles. The panel has a major axis extending between and bisecting the first angles, and a minor axis extending between and bisecting the second angles. The panel has a dihedral root portion extending along the major axis and dividing the panel into two similar triangular panel portions which extend from the dihedral root portion at a nominal dihedral angle to each other when viewed along the major axis. Margin portions of the panel extend along each side edge, at least two of the margin portions being adapted to cooperate with, and to be secured to, similar margin portions of adjacent panels to form an assembly of building panels. A crowned central portion is provided in each triangular panel portion. Each crowned central portion is displaced laterally from a nominal plane containing the margin portions of two side edges of the respective triangular panelled portion and the dihedral root portion, the central portion merging smoothly with adjacent margin portions.

Preferably, the first angles are acute, and the second angles are obtuse. Also, preferably the crowned central portion of a particular triangular panel is bowed smoothly outwardly from the nominal plane and on a similar side of the plane as the remaining adjacent triangular panel portion.

Alternate building panels according to the invention are generally triangular in shape and are used in specific locations on the building assembly, in combination with the previously described quadrilateral panels. One triangular panel is used adjacent an end portion of the building, and is effectively one-half of the quadrilateral panel cut along the major axis, i.e. along the dihedral root portion, with a reinforcing flange substituted for the remaining panel portion. Another triangular panel is used adjacent foundations of the building and is effectively one-half of the quadrilateral panel cut along the minor axis. Again, a reinforcing flange is provided along the edge of the panel adjacent the minor axis, to form an outer edge of the panel.

A detailed disclosure following, relating to drawings, describes preferred embodiments of the invention which are capable of expression in structure other than those particularly described and illustrated.

DESCRIPTION OF THE DRAWINGS

FIG. 6 is a simplified transverse cross-section of the top panel, as seen on line 6—6 of FIG. 4, FIG. 7 is a simplified longitudinal cross-section of the top panel, as seen on line 7—7 of FIG. 4, FIG. 8 is a simplified longitudinal cross-section of the top panel, as seen on line 8—8 of FIG. 4, a plane of the section being spaced transversely outwardly from a plane of the section of FIG. 7, FIG. 9 is a simplified top plan of a "side panel" of the invention, FIG. 10 is a simplified longitudinal cross-section of the side panel, as seen from line 10—10 of FIG. 9, FIG. 11 is a simplified top plan of an "end panel" of the invention, FIG. 12 is a simplified side elevation of the end panel of FIG. 11, FIG. 13 is a simplified transverse cross-section of the end panel, as seen on line 13—13 of FIG. 11, FIG. 14 is a simplified top plan of a "bottom panel", FIG. 15 is a simplified longitudinal section of the bottom panel, as seen on line 15—15 of FIG. 14, FIG. 16 is an end view of the bottom panel of FIG. 14.

DETAILED DISCLOSURE

Figure 1:
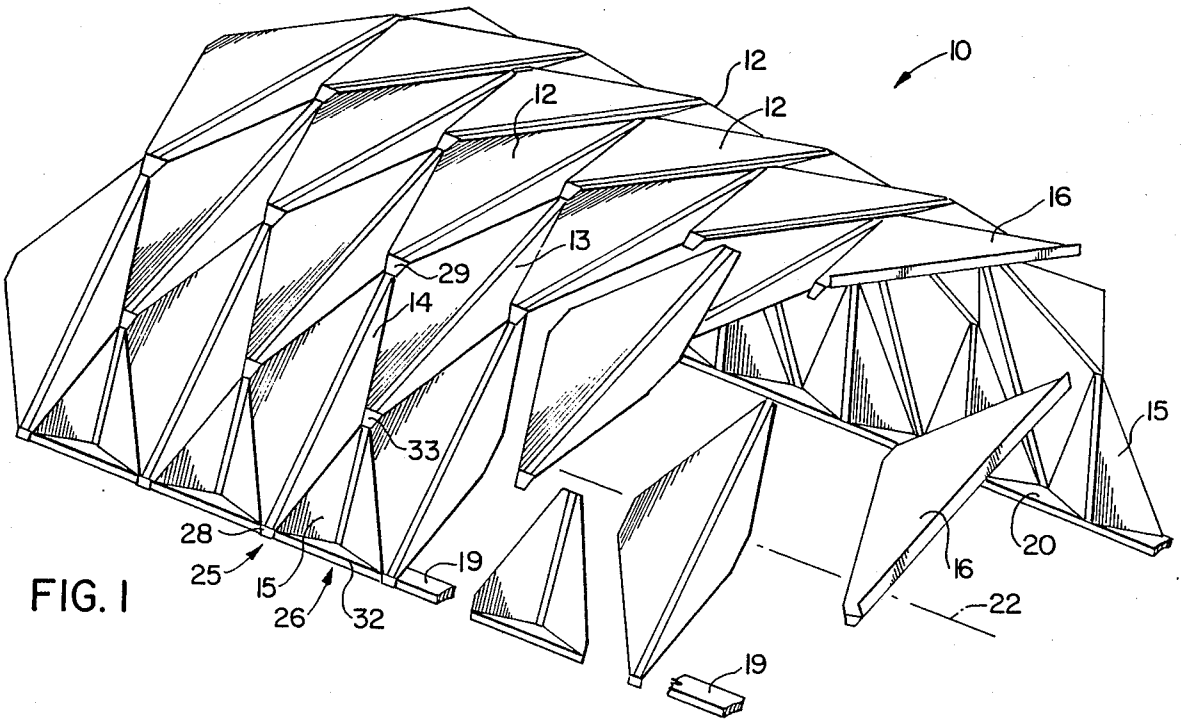
FIG. 1 is a fragmented simplified perspective of a building formed from an assembly of building panels according to the invention, some of the panels being shown separated from the building for clarification.
Figure 2:
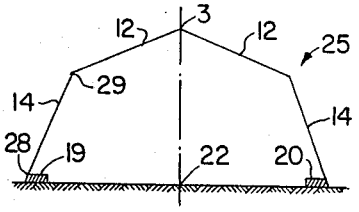
FIG. 2 is a diagramatic elevation of a first arch portion of the building.
Figure 3:
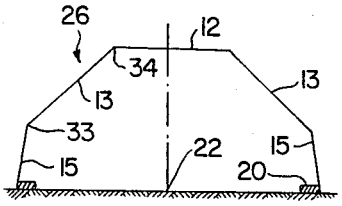
FIG. 3 is a diagramatic elevation of a second arch portion of the building.

FIGS. 1, 2 and 3

A building 10 includes an assembly of several different types of building panels according to the invention. There are basically three generally quadrilateral-shaped panels, namely a top panel 12, a side panel 13, and a full bottom panel 14. There are also two generally triangular-shaped panels, namely a half bottom panel 15, and an end panel 16. The building is supported on a pair of laterally spaced apart parallel elongated foundation members 19 and 20 which are generally rectangular in cross-section and spaced equally from a longitudinal axis 22 of the building.

The building can be extended longitudinally essentially indefinitely by adding two types of arch portions of panels as required. The building consists of a plurality of pairs of such arch portions which alternate longitudinally along the building, the arch portions being designated a first arch portion 25, and a second arch portion 26. Referring to FIGS. 1 and 2, one-half of the arch portion 25 includes a full bottom panel 14 secured at a lower junction 28 to the foundation member 19, and at an upper junction 29 to a top panel 12. As seen in FIG. 2 only, the remaining half of the arch 25 is generally similar and has a second full bottom panel 14 secured to the foundation member 20, and a second top panel 12 secured at an uppermost junction 30 to the first top panel 12, the junction 30 being positioned over the longitudinal axis 22.

Referring to FIGS. 1 and 3, one-half of the second arch portion 26 includes a half bottom panel 15 secured at junction 32 to the foundation member 19, and a side panel 13 secured at junction 33 to the panel 15. A top panel 12 is secured at a junction 34 to the panel 13, and is disposed symmetrically of the axis 22 so as to cooperate with a similar second side panel 13 on the remaining half of the arch portion 26. A similar second half bottom panel 15 is secured to the foundation member 20. Referring only to FIG. 1, an end of the building is defined by a pair of triangular end panels 16 which cooperate with a single top panel 12 of an adjacent arch portion 14, and a pair of half bottom panels 15, one only being shown in FIG. 1, which extend to outer end portions of the foundation members 19 and 20.

As can be seen from FIG. 1, the resulting structure of the building resembles somewhat the structure shown in Canadian Pat. No. 1,004,822 and corresponding U.S. Pat. No. 3,874,141. However, detailed examination of the geometry of the panels themselves shows differences which are necessary to accommodate the differences in physical characteristics of the materials used in the construction of the two types of buildings. In the Canadian and corresponding U.S. patents above, the strength of the steel panel is derived by strategically placed folds or ribs formed in the panels, which increase considerably the stiffness of the panel. In the present invention, the panels are fabricated from a fibre reinforced cement composition, well known in the trade, which is inherently weak when subjected to tensile forces. Thus geometry of the panels is changed from that of the patented steel panels to essentially eliminate the cement composition panels being subjected to tensile forces. Instead, the panels are subjected mainly to compressive forces, and, to prevent buckling, the panels have generally similar bowed portions, which approximate to portions of a thin shelled sphere, which results in most portions of the panels being subjected to compressive stresses when assembled.

FIGS. 4 through 8

Figure 4:
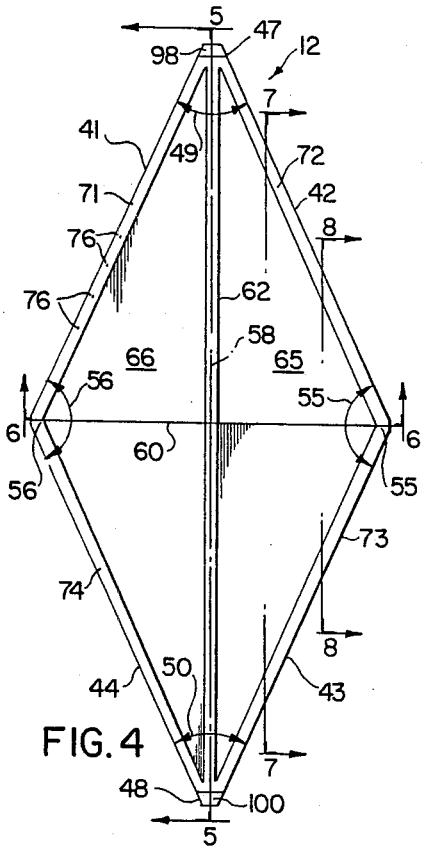
FIG. 4 is a simplified top plan of a "top panel" of the invention.

Referring mainly to FIG. 4, the top panel 12 has a periphery including four generally straight side edges 41, 42, 43 and 44 which define a generally quadrilateral panel. The panel has oppositely disposed, upper and lower first corners 47 and 48 defined by intersecting side edges 41 and 42, and 43 and 44 respectively, the intersecting pairs of side edges being inclined to each other at equal upper and lower first angles 49 and 50 respectively. The panel 12 also has oppositely disposed right hand and left hand second corners 55 and 56, defined by intersecting side edges 42 and 43, and 41 and 44 respectively, which side edges are inclined to each other at equal right hand and left hand second angles 55 and 56 respectively. It can be seen that the first angles 49 and 50 are acute, and the second angles 55 and 56 are obtuse, and that the side edges 41 through 44 are equal in length. Thus the quadrilateral panel as described herein approximates to a general rhombus shape, having parallel opposite sides of generally equal length.

The panel 12 has a major axis 58 extending between and bisecting the first angles 49 and 50, and a minor axis 60 extending between and bisecting the second angles 55 and 56. Clearly, the axes 58 and 60 intersect each other at midpoints thereof, and at right angles to each other.

The panel has a dihedral root portion 62 extending along the major axis 58 and dividing the panel into similar triangular right hand and left hand panel portions 65 and 66. The panel portions 65 and 66 extend from the dihedral root portion 62 at a nominal dihedral angle 68 to each other when viewed along the major axis 58, as best seen in FIG. 6. The angle 68 is about 127 degrees and the axes 58 and 60 are approximately 260 centimeters and 120 centimeters respectively.

Figure 18:
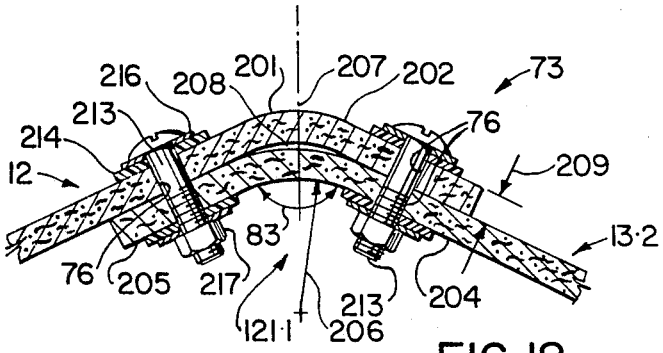

The panel 12 has margin portions 71, 72, 73 and 74 extending along side edges 41, 42, 43 and 44 respectively. When the panels are assembled in a building, at least two of the margin portions are adapted to cooperate with, and to be secured to, similar margin portions of adjacent panels to form the assembly. Consequently, the margin portions can be provided with the plurality of openings, for example bolt or screw openings 76 (only a few being shown) spaced equally along the margin portions which can be registered with similar openings in adjacent panels so as to receive fasteners therethrough, as seen in FIG. 18. As will also be described with reference to FIG. 18, and as seen in FIG. 6, the margin portions have a particular cross-section which is generally complementary to other margin portions of adjacent panels. Thus the margin portion 71 on one side of the panel 12 is complementary to the margin portion 72 on the opposite side. The margin portion 71 has margin inner and outer portions 81 and 82 respectively, which are generally straight flat strips which are connected together by a short curved portion so as to be inclined at a marginal angle 83 to each other. The angle 83 is about 127 degrees and is disposed symmetrically about an axis 85 which is parallel to an axis 86 extending through the major axis 58, and bisecting the dihedral angle 68.

The dihedral root portion 62 is generally similar in cross-section to the margin portion, although there are slight differences for fitting purposes. A left hand portion 78 of the dihedral root portion 62 is a generally straight flat-strip which is generally co-planar with the margin inner portion 81. Thus a nominal panel plane 88 can extend between lower surfaces of the dihedral root portion 62 and the margin inner portion 81. A right hand portion 79 of the dihedral root portion 62 is a similar generally straight flat portion connected to the portion 78 by a short curved portion so as to be inclined similarly to the margin portion 79.

As best seen in FIG. 6, the triangular panel portion 66 has a crowned central portion 90 which is displaced laterally from the nominal panel plane 88 by a maximum crown spacing 91 generally adjacent the centre of the panel 66. It can be seen that the crowned central portion of the panel portion 66 is bowed transversely smoothly outwardly from the nominal panel plane 88 and on a similar side of the plane as the remaining adjacent triangular panel portion 65. In other words, the crowned central portion 90 is displaced in the same general direction from the nominal plane 88 of the particular triangular panel portion as the remaining adjacent triangular panel portion 65 of the panel 10.

The opposite or remaining panel portion 65 has a similar crowned central portion 93 which is displaced at a maximum crown spacing 94 from a similar nominal panel plane 95 of the panel 65. Thus, a crowned central portion 90, 93, is provided in each triangular panel portion, 66, 65, respectively, and each crowned central portion is displaced laterally from a nominal panel plane i.e. 88, 95, respectively. The plane 88 contains margin portions 71 and 74 of the triangular panel portion 66 and the portion 78 of the dihedral root portion 62. Similarly, the plane 95 contains the margin portions 72 and 73 and the portion 79 of the dihedral root portion 62. The crowned central portions 90 and 93 merge smoothly with adjacent margin portions and the dihedral root portion to reduce stress concentration in the panel. It can be seen in FIG. 6 that the margin inner portion 81 blends smoothly with the crowned central portion, and the margin outer portion 82 has a relatively straight edge defining the side edge 41 of the panel.

As seen in FIGS. 7 and 8, when viewed as longitudinal sections the triangular panel portion 65 is similarly bowed longitudinally smoothly from the nominal plane 88. Thus the crowned central portions are bowed within two planes and are preferably approximate to portions of a thin-shelled sphere, edges of which are defined approximately by inner margin portions of two side edges, and the dihedral root portion. The maximum crown spacing is sufficient to ensure that most of the panel is not subjected to high tensile loads when assembled, but instead, similarly to an arch, is subjected to compression loads which the fibre reinforced cement material can withstand adequately. For a triangular panel having a thickness of approximately 4.5 millimeters and a lateral dimension, i.e. one-half of the minor axis 60, of approximately 60 centimeters, the maximum crown spacing 91 or 95 is approximately 2 centimetres although some variations are possible.

As best seen in FIG. 6, the margin inner portion 81 of the particular margin portion 71 is generally within the nominal panel plane 95, and the margin outer portion 82 of the said particular margin portion 71 is generally parallel to the nominal plane 95 of the remaining triangular panel portion 65. In this way, when adjacent panels are connected together, the margin portions of one panel are generally complementary to adjacent margin portions of another panel.

Figure 5:
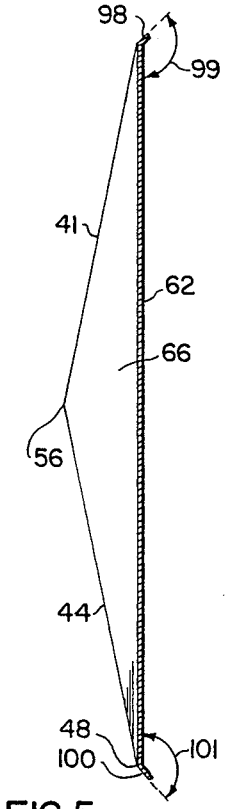
FIG. 5 is a simplified longitudinal cross-section of the top panel, as seen on line 5—5 of FIG. 4.

As stated previously, the panel 12 is a top panel and differs from some of the remaining panels in particular structure related to its position in the arch portion. As seen in FIG. 4, the margin portions 71, 72, 73 and 74 extend essentially completely around the periphery of the panel, without a break. Also, the margin portions adjacent the first corner 47 extend axially to form an extension 98 which extends from an adjacent end of the dihedral root portion 62. As seen in FIG. 5, the extension 98 is inclined to the root portion in a direction opposite to inclination of the triangular panel portions to the root portion. In other words, the extension 98 is inclined at an angle 99 to the dihedral root portion 62, which is on a side of the root portion remote from the right hand and left hand triangular panel portions 65 and 66. Similarly, the margin portions 73 and 74 adjacent the corner 48 form an extension 100 which extends from adjacent ends of the dihedral root portion 62 and is inclined oppositely to the inclination of the triangular panels 65 and 66 relative to the root portion. As seen in FIG. 5, the extension 100 is inclined at an angle 101 to the root portion 62. The extensions 98 and 100 overlap adjacent panels to shed water similarly to overlapping roof tiles, as will be described with reference to FIG. 17.

FIGS. 9 and 10

The side panel 13 closely resembles the top panel 12 and has right hand and left hand triangular panel portions 113 and 114 extending from a dihedral root portion 116 which extends along a major axis 117 of the panel 13. The panel portion 113 has margin portions 119 and 120, and the panel 114 has similar margin portions 121 and 122 respectively. The panel has upper and lower first corners 124 and 125 and right hand and left hand second corners 127 and 128. A minor axis 118 is disposed normally to the major axis 117. The panel 13 thus far described is generally similar to the panel 12.

A major difference between the panels 13 and 12 relates to the margin portions adjacent the corners 124, 127 and 128 as follows. The margin portions 119 and 121 adjacent the upper first corner 124 have ends 130 and 131 respectively which are tapered relative to the respective side edges of the panel, so as to be aligned with each other and to be generally parallel to the minor axis 118 of the panel. Thus, an upper extension of the margin portions similar to the extension 98 of the panel 12 is eliminated. Thus the upper first corner 124 is "mitred or clipped" which prevents interference with adjacent panels and facilitates overlapping by an upper panel to improve shedding of water.

The margin portions 119 and 120 adjacent the second corner 127 have ends 133 and 134 respectively which are tapered relative to the respective side edges of the panel so as to be aligned with each other and to be generally parallel to the major axis 117 of the panel. Similarly, the margin portions 121 and 122 adjacent the second corner 128 have ends 136 and 137 respectively which are tapered relative to the respective side edges of the panel, so as to be aligned with each other and to be generally parallel to the major axis of the panel. Thus, intersections or extensions of the margin portions at ends of the minor axis 118 to produce corners similar to the corners 55 and 56 of the panel 12 are eliminated from this panel. Thus the second corners 127 and 128 are "mitred or clipped" also which prevents interference with adjacent panels.

As can be seen, the margin portions 120 and 122 adjacent the remaining lower first corner 125 form an extension 139 which extends downwardly from adjacent ends of the root portion, and is inclined at an angle 140 to the root portion 116 in a direction opposite to the inclination of the triangular panel portions to each other, and thus is basically similar to the first corner 48 and the extension 100 of the panel 12.

The full bottom panel 14 is generally similar to the side panel 13, with the exception that a downward extension of the panel 14 that is equivalent to the extension 139 at the lowermost portion is extended further, so as to provide an increased overlap for the foundation members 19 and 20. Thus, as shown in FIG. 10, an alternative extension 141 for the full bottom panel 14 is shown in broken outline and extends beyond the extension 139 necessary for the side panel. Apart from this increase in length of the extension, the full bottom panel 14 and the side panel 13 are identical.

FIGS. 11 through 13

The end panel 16 is basically one-half of a side panel 13, which has been bisected along the major axis 117 thereof, with an extended flange adjacent the axis 117, i.e. adjacent the dihedral root portion. Thus, the end panel 16 has two generally straight side edges 144 and 145 provided with respective margin portions 146 and 147 extending therealong. The margin portions 146 and 147 are adapted to be secured to adjacent panels of the building, whereas a remaining open end inner edge portion 149 of the panel forms a portion of the open end of the building. The inner edge portion 149 has two outer end portions 142 and 143 and intersects the side edges 144 and 145 at equal upper and lower angles 151 and 152. The edges 144 and 145 intersect each other at a left hand angle 154 to form an intermediate corner 148. The margin portions 146 and 147 adjacent the intermediate corner 148 are tapered relative to the side edges so as to be aligned with each other and to be generally parallel to the inner edge portion 149, similarly to the panel 13. Thus the margin portions are mitred to eliminate interference with adjacent panels.

Similarly to the previously described triangular panel portions, the panel 16 has a crowned central portion 156 which is bowed laterally from a nominal plane 158 of the panel a maximum crown spacing 155. As best seen in FIG. 13, the inner edge portion 149 has an upwardly extending edge flange 160 which extends from the plane 158 in the same direction as crowned central portion 156. The flange 160 serves to stiffen the otherwise unsupported edge of the panel. An extension 159 extends from the lower end portion 143 as extensions of the inner edge portion 149 and a flat strip 159 adjacent the flange 160 and is equivalent to the extension 139 of the panel 13. Clearly, the panel 16 functions in a manner essentially identical to one-half of a side panel 14 and requires no further description.

FIGS. 14 through 16

The half bottom panel 15 resembles approximately a top half of a side panel 13, bisected along the minor axis 118, with an extended flange adjacent the axis 118 which forms a lower or inner edge portion 162 of the panel 15. The edge portion 162 has a flat portion 163 having a generally straight edge flange 164 extending therealong. The flat portion 163 and flange 164 engage adjacent top and side edges of the foundation means 19, shown in broken outline in FIG. 15. The edge flange has two outer end portions 166 and 167 spaced apart a distance 169 which is approximately equal to length of the minor axis 118 of the side panel 13. Two generally straight side edges 171 and 172 extend symmetrically from the outer end portions 166 and 167 respectively at equal edge angles 173 and 174 to intersect at an intermediate corner 176. This defines a generally triangular-shaped periphery as best seen in FIG. 14.

Margin portions 179 and 180 extend along the side edges 171 and 172 respectively, at least one of the margin portions being adapted to cooperate with, and to be secured to, an adjacent building panel. A dihedral root portion 183 extends normally from a centre portion 184 of the edge portion 162 to the intermediate corner 176. First and second crowned panel portions 187 and 188 are disposed on respective sides of the dihedral root portion. As best seen in FIG. 16, the crowned portion 187 is displaced laterally from a nominal panel plane 190 which contains the margin portions 179, the root portion 183 and the edge portion 162. Similarly, the crowned portion 188 is displaced laterally from a nominal panel plane 192 which contains the margin portion 180, the root portion 183 and the edge portion 162.

It can be seen that the two generally triangular panels 15 and 16 (of FIGS. 11–16) each have an inner edge portion having a generally straight edge flange extending therealong, the edge flange being generally perpendicular to the edge portion and having two outer end portions. Each panel 15 and 16 also has two generally straight side edges extending symmetrically from the outer end portions of the edge flange at equal edge angles to intersect at an intermediate corner to define a generally triangular shaped periphery. Margin portions of each panel extend along each side edge, at least one of the margin portions being adapted to cooperate with, and to be secured to, an adjacent building panel. Each triangular panel has at least one crowned central portion displaced laterally from a nominal plane containing the margin portions of the side edges and the edge portion. Margin portions adjacent at least one corner are tapered relative to the respective side edges so as to be aligned with each other.

Figure 17:
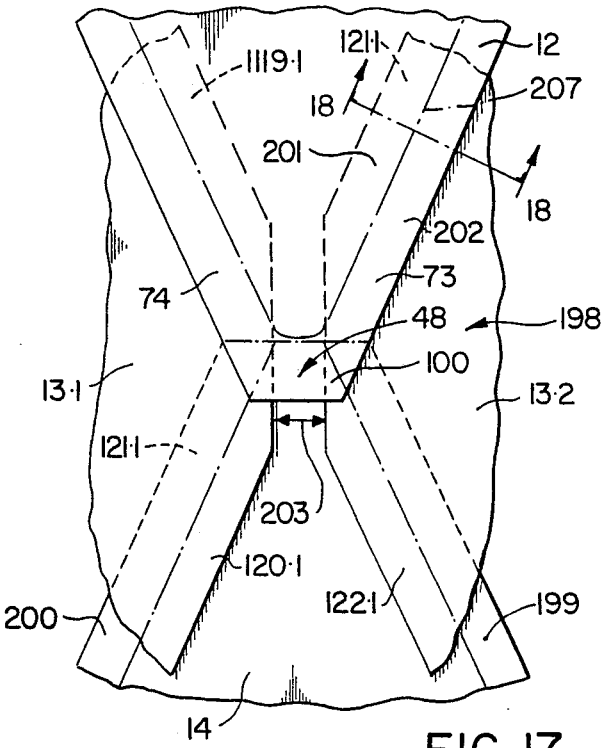
FIG. 17 is a simplified fragmented top plan of a connection between four panels of the invention adjacent a "hub", FIG. 18 d fragmented cross-section on line 18—18 of FIG. 17, showing a connection between two panels of the invention.

FIGS. 17 and 18

Referring to FIG. 17, a typical intersection 198 or hub of the building is shown, where a top panel 12, a full bottom panel 14, and two side panels 13.1 and 13.2 intersect and are secured together. The margin portions 73 and 74 adjacent the corner 48 of the panel 12 overlap a margin portion 121.1 of the side panel 13.2, and an opposite and similar margin portion 119.1 of the side panel 13.1. The margin portions 121.1 and 119.1 are in relative positions on the panels 13.2 and 13.1 respectively similar to the margin portions 121 and 119 on the panel 13. A margin portion 122.1 of the panel 13.2, and a similar and opposite margin portion 120.1 of the panel 13.1 overlap complementary and similar margin portions 199 and 200 of the adjacent upper portions of the full bottom panel 14, which correspond to the side margins of the side panel. The mitred margin portions provide a clearance 203 between the second corner of the panels 13.1 and 13.2 to avoid interference. The extension 100 overlaps the panels 13.1, 13.2 and 14 to shed water.

As best seen in FIG. 18, the margin portion 73 of the panel 12 has an inner margin portion 201 and an outer margin portion 202. Similarly, the margin portion 121.1 of the side panel 13.2 has an inner margin portion 204 and an outer margin portion 205. The inner and outer margin portions are disposed to each other at the marginal angle 83, as described with reference to FIG. 6. The inner margin portion 201 is disposed within a plane generally parallel to the outer margin portion 205, and similarly the outer margin portion 202 is generally parallel to the inner margin portion 204. Radii 206 of fillets between adjacent marginal portions and generally adjacent a vertical plane 207 differ slightly to provide a capillary break 208 which is sufficient to prevent water being drawn between the margin portions 202 and 204, past the plane 207 and through the margin portions 201 and 205 into the building. The material between the margin portions has a radius of approximately 2.5 centimeters and that the panels have a thickness 209 of approximately 4.5 millimeters.

When assembled, the openings 76 in the panel 12 are generally aligned with similar openings 76 in the margin portions of the panel 13.2. The openings receive screws 213 fitted with resilient washers 14, stiff washers 216 and nuts 217.

OPERATION

The building can be assembled easily, using relatively unskilled on-site labour and not requiring any specialized lifting or forming equipment.

The foundation means 19 and 20 are laid on a level pad, so as to be parallel to each other and level. The full bottom panels 14 and half bottom panels 15 are initially secured along the foundation means using suitable fasteners, and the side panels and top panels are then added sequentially to form each successive arch portions which, when completed, have sufficient strength to support themselves as adjacent arch portions are completed. As fibre reinforced cement panels tend to be relatively brittle, care is taken to ensure that screws are tightened evenly without subjecting the panels to excessive bending loads. The foundation means can be secured to a concrete pad, or the concrete pad can be poured between the foundation means when the building is assembled.

ALTERNATIVES

The building is shown assembled from a plurality of two types of arch portions, one type having four panels, and the other type having three panels plus two half panels. Buildings using generally similar panels can be assembled with different arch configurations using different numbers of panels per arch. Also the corner angles and dihedral angles of the panels can be modified. Irrespective of the numbers of the panels, and the angles of the panels, all the panel portions should have crowned central portions to eliminate essentially tensile forces from the panels.

We claim:

1. A fiber reinforced cement composition building panel having:

(a) a periphery including four generally straight side edges which define a generally quadrilateral panel having a pair of oppositely disposed first corners defined by intersecting side edges inclined to each other at equal first angles, and a pair of oppositely disposed second corners defined by intersecting side edges inclined to each other at equal second angles, (b) a major axis extending between and bisecting the first angles, and a minor axis extending between and bisecting the second angles, (c) a dihedral root portion extending along the major axis and dividing the panel into two similar triangular panel portions which extend from the dihedral root portion at a nominal dihedral angle to each other when viewed along the major axis, (d) margin portions extending along each side edge, at least two of the margin portions being adapted to cooperate with, and to be secured to, similar margin portions of adjacent panels to form an assembly of building panels, (e) a crowned central portion provided in each triangular panel portion, each crowned central portion being displaced laterally from a nominal plane containing the margin portions of the two side edges of the respective triangular panel portion and the dihedral root portion, the crowned central portion of the particular triangular panel portion being bowed smoothly outwardly from the nominal plane and on a similar side of the plane as the remaining adjacent triangular portion, the central portions merging smoothly with adjacent margin portions, (f) all panel portions having relatively thin wall sections.

2. A panel as claimed in claim 1 in which:

(a) the first angles are acute, and (b) the second angles are obtuse.

3. A panel as claimed in claim 1 in which:

(a) the crowned central portion of a particular triangular panel portion is displaced in the same general direction from the nominal plane of the particular triangular panel portion as the remaining adjacent triangular panel portion of the panel.

4. A panel as claimed in claim 1 in which:

(a) each crowned central portion is bowed within two planes and approximates to portions of a thin-shelled sphere having edges defined approximately by the margin portions of the respective side edges ad the dihedral root portion.

5. A panel as claimed in claim 1 in which:

(a) each margin portion has margin inner and outer portions which are inclined at a marginal angle to each other, the margin inner portion blending smoothly with the crowned central portion, and the margin outer portion having a relatively straight edge defining the side edge of the panel.

6. A panel as claimed in claim 5 in which:

(a) the panel has first and second triangular panel portions, (b) the margin inner portion of a particular margin portion of the first triangular panel portion is generally within the nominal plane of the first triangular panel portion, and the margin outer portion of the said particular margin portion is generally parallel to a nominal plane of the remaining second triangular panel portion, so that, when adjacent panels are connected together, the margin portions of one panel are generally complementary to adjacent margin portions of another panel.

7. A panel as claimed in claim 1 in which the panel is a top panel of the assembly, and in which:

(a) the margin portions extend essentially equally completely around the periphery of the panel, (b) the margin portions adjacent the first corners form an extension which extends from adjacent ends of the dihedral root portion and is inclined in a direction opposite to the inclination of the triangular panel portions to each other.

8. A panel as claimed in claim 1 in which the panel is a side panel of the assembly, and in which:

(a) the margin portion adjacent the second corners have ends which are tapered relative to the respective side edges of the panel, so as to be aligned with each other and to be generally parallel to the major axis of the panel, (b) the margin portions adjacent one first corner have ends which are tapered relative to side edges of the panel so as to be aligned with each other and to be generally parallel to the minor axis of the panel, (c) the margin portions adjacent the remaining first corner of the panel form an extension which extends from adjacent ends of the dihedral root portion and is inclined in a direction opposite to the inclination of the triangular panel portions to each other.

9. A panel as claimed in claim 1 in which:

(a) the panel is fabricated from a fibre reinforced cement composition, (b) the nominal dihedral angle between adjacent panels is approximately 127 degrees, as measured between nominal planes of the panels.

10. A panel as claimed in claim 1 in which:

(a) the margin portions of the panels are provided with a plurality of openings which can be registered with similar openings in adjacent panels, so as to receive fasteners therethrough.

11. A fiber reinforced cement composition building panel having:

(a) an inner edge portion having a generally straight edge flange extending therealong, the edge flange having two outer end portions, (b) two generally straight side edges extending symmetrically from the outer end portions of the edge flange at equal edge angles thereto to intersect at an intermediate corner to define a generally triangular-shaped periphery, (c) margin portions extending along each side edge, at least one of the margin portions being adapted to cooperate with, and to be secured to, an adjacent building panel, (d) at least one crowned central portion displaced laterally from a nominal plane containing the margin portions of the side edges and the edge portion, the said at least one crowned central portion being bowed smoothly outwardly from the nominal plane, (e) all panel portions having relatively thin wall sections.

12. A panel as claimed in claim 11 in which the panel is an end panel, and in which:

(a) the edge flange extends from the nominal plane in the same direction as the crowned portion.

13. A panel as claimed in claim 12 in which:

(a) the margin portions adjacent the intermediate corner are tapered relative to the side edges so as to be aligned with each other and to be generally parallel to the edge portion.

14. A panel as claimed in claim 11 in which the panel is a half bottom panel, and in which:

(a) the inner edge portion has a flat portion disposed normally to the nominal panel plane, (b) a dihedral root portion extends normally from a centre portion of the edge portion to the intermediate corner to define two triangular panel portions, one panel portion being on each side of the root portion, (c) a crowned panel portion is provided in each triangular panel portion disposed on each side of the dihedral root portion, each crowned panel portion being disposed laterally in the same direction from the nominal panel plane as the edge flange.

15. A panel as claimed in claim 11 in which:

(a) the said at least one crowned central portion is bowed within two planes, and approximates to portions of a thin-shelled sphere having edges defined approximately by the margin portions of the respective side edges and the dihedral root portion.

* * * * *